US010745155B2

(12) United States Patent
Vazul et al.

(10) Patent No.: US 10,745,155 B2
(45) Date of Patent: Aug. 18, 2020

(54) RETAIL-READY PACKAGING OF POUCHED PRODUCT

(71) Applicant: KHS GmbH, Dortmund (DE)

(72) Inventors: Luke L. Vazul, Clearwater, FL (US); Michael Sammons, Parrish, FL (US); Sean Patrick Wells, Mukwonago, WI (US); Kristi Nordlund, Sarasota, FL (US); Roger Calabrese, Bradenton, FL (US)

( * ) Notice: Subject to any disclaimer, the term of this patent is extended or adjusted under 35 U.S.C. 154(b) by 1933 days.

(21) Appl. No.: 14/018,546

(22) Filed: Sep. 5, 2013

(65) Prior Publication Data

US 2015/0059286 A1 Mar. 5, 2015

(51) Int. Cl.

| | |
|---|---|
| ***B65B 5/08*** | (2006.01) |
| ***B65B 35/18*** | (2006.01) |
| ***B65B 35/24*** | (2006.01) |
| ***B65B 61/28*** | (2006.01) |

(52) U.S. Cl.

CPC ..... *B65B 5/08* (2013.01); *B65B 35/18* (2013.01); *B65B 35/243* (2013.01); *B65B 61/28* (2013.01)

(58) Field of Classification Search

CPC ..... B65B 5/08; B65B 35/18; B65B 35/243; B65B 61/28; B65G 47/57; B65G 2812/019; B65G 2812/02227; B65G 15/14

USPC ..... 198/607, 801; 414/21; 53/167

See application file for complete search history.

(56) References Cited

U.S. PATENT DOCUMENTS 3,520,396 A * 7/1970 Gerhard ..... B65G 67/603 198/418.6
3,556,237 A * 1/1971 Allison ..... G01G 3/142 177/200
3,643,816 A * 2/1972 Jacobsen ..... B65G 37/005 271/218
3,676,978 A * 7/1972 Gottweis ..... B65B 5/067 198/360
3,698,542 A * 10/1972 Reger ..... B65G 25/10 198/468.8
3,771,825 A * 11/1973 Yamada ..... B25J 15/0206 294/106
4,800,703 A * 1/1989 Goodman ..... B65B 5/08 53/244
4,856,643 A * 8/1989 Lachonius ..... B65G 15/14 198/626.5
4,913,617 A * 4/1990 Nicholson ..... B25J 9/0084 294/86.4
5,024,575 A * 6/1991 Anderson ..... B65G 47/90 294/2
5,113,992 A * 5/1992 Sadamori ..... H01L 21/67778 198/347.1
5,337,887 A * 8/1994 Greenwell ..... B65G 17/26 198/473.1
5,361,893 A * 11/1994 Lapeyre ..... B65G 17/08 198/690.2
5,403,056 A * 4/1995 Wallace ..... B25J 15/0023 294/98.1

(Continued)

*Primary Examiner* — Thanh K Truong
*Assistant Examiner* — Patrick B Fry
(74) *Attorney, Agent, or Firm* — Occhiuti & Rohlicek LLP

(57) ABSTRACT

An apparatus for placing pouches in retail-ready cartons includes pouch placer having an elevator assembly having paddles for receiving pouches provided by a first conveyor, and lifting the pouches, and a first robot arm for retrieving a pouch from a paddle of the elevator assembly and placing it in a retail-ready carton.

18 Claims, 6 Drawing Sheets

(56) References Cited

U.S. PATENT DOCUMENTS

| | | | | |
|---|---|---|---|---|
| 6,305,530 | B1 * | 10/2001 | Guldenfels | B65G 17/08 198/850 |
| 7,156,607 | B2 * | 1/2007 | Anderson | B65G 57/308 198/347.1 |
| 7,409,812 | B2 * | 8/2008 | Gilmore | B25J 15/0052 53/258 |
| 7,514,639 | B2 * | 4/2009 | Heuer | B66C 13/16 177/147 |
| 7,644,558 | B1 * | 1/2010 | Fallas | B25J 9/0093 53/251 |
| 7,654,786 | B2 * | 2/2010 | Kwon | B65G 49/061 414/226.02 |
| 8,905,221 | B2 * | 12/2014 | Young | B65G 57/308 198/347.1 |
| 8,997,438 | B1 * | 4/2015 | Fallas | B65G 47/914 414/222.01 |
| 9,187,258 | B2 * | 11/2015 | Zhang | B65G 37/005 |
| 2012/0006651 | A1 * | 1/2012 | Cote | B25J 9/0084 198/468.6 |

* cited by examiner

RETAIL-READY PACKAGING OF POUCHED PRODUCT

FIELD OF DISCLOSURE

This disclosure relates to retail-ready packaging, and in particular, to filling retail-ready packages with pouched products.

BACKGROUND

In the early days of retailing, a retailer would receive a large box of goods from a manufacturer. Inside the box were retail units of some product. The retailer would then perform an operation called "restocking the shelves." This would involve taking the individual retail units from the box and placing them neatly on the shelves to create an attractive display. The box, however, would remain in a back room, invisible to retail customers.

One difficulty with this system is an obvious one. It is tedious to restock the shelves one retail unit at a time.

Another, more pernicious, difficulty arises from the fact that the mere presence of a retail unit on the shelf, particularly one with an eye-catching design, calls attention to itself and stimulates sales. As more people buy, the number of units decreases, and hence the commercial impression of the retail units decreases. This creates a negative feedback loop in which as the rate of sales of retail units increases, the commercial impression created by the aggregate of retail units decreases.

In modern retailing, a retailer again receives a large box of goods from a manufacturer. However, inside the box are several smaller cartons, often called "retail-ready packages." These cartons typically have an attractive design printed on them, and a perforation that can be torn away to reveal the individual retail units available for purchase. To re-stock shelves, the retailer simply tears the carton carefully at the perforation and places the entire carton on the shelf. This simplifies re-stocking considerably, since it is no longer necessary to carefully arrange the retail units on a shelf. In addition, even if all retail units have been sold, the carton remains and continues to create a commercial impression.

A difficulty in retail-ready packaging is that the retail units must be placed in the carton in a neat and attractive way.

Certain kinds of retail units are rigid and have a well-defined size and shape. Examples are boxes, cans, bottles, shrink-wrapped items, such as diapers or paper towels, cartons, such as milk cartons, and plastic containers, such as those used for yogurt. For these retail units, it is known to use a robot to pick individual retail units off a conveyor and place them in a retail-ready carton.

However, there is one common type of retail unit that lacks these properties: the pouch. Pouches, such as those used to package chips and nuts, are deformable, and tend not to have a uniform shape. This causes great difficulty for robots. As a result, it is not uncommon to fill retail-ready cartons by hand.

SUMMARY

In one aspect, the invention features an apparatus for placing pouches in retail-ready cartons. Such an apparatus includes a pouch placer including an elevator assembly having paddles for receiving pouches provided by a first conveyor, and lifting the pouches, and a first robot arm for retrieving a pouch from a paddle of the elevator assembly and placing the pouch in a retail-ready carton.

Embodiments of the invention include those that further include a weight-measurement device for weighing a pouch while the pouch is being moved. These include embodiments in which the weight measurement device is integrated with the first robot arm, as well as embodiments in which the weight-measurement device is integrated into a second robot arm that causes pouches to be provided to the pouch packaging machine.

In some embodiments, the effector includes a clamp having first and second grippers having faces opposed to each other for gripping a pouch, wherein the second gripper includes a spatula for supporting the pouch. Among these are embodiments that include including a vacuum source, wherein the spatula includes a surface having holes in communication with the vacuum source.

Also among the embodiments of the invention are those that further include a pouch filling machine for providing filled pouches to the pouch placement machine and those that include an erection machine for erecting retail-ready cartons for receiving the pouches, and a second conveyor for conveying the erected cartons to the second robot arm.

In some embodiments, the elevator assembly includes a first elevator tower, and a chain for conveying paddles up a vertical section of the first elevator tower. Among these are embodiments in which the vertical section faces a first conveyor belt that delivers filled pouches, embodiments in which the first tower leans away from a conveyor belt that delivers filled pouches to the pouch placer, and embodiments that include a second elevator tower and a chain conveying paddles up a vertical section of the second elevator tower, wherein the vertical section of the second tower faces the vertical section of the first tower.

These and other features of the invention will be apparent from the following detailed description and its accompanying figures, in which

DETAILED DESCRIPTION

Figure 1:
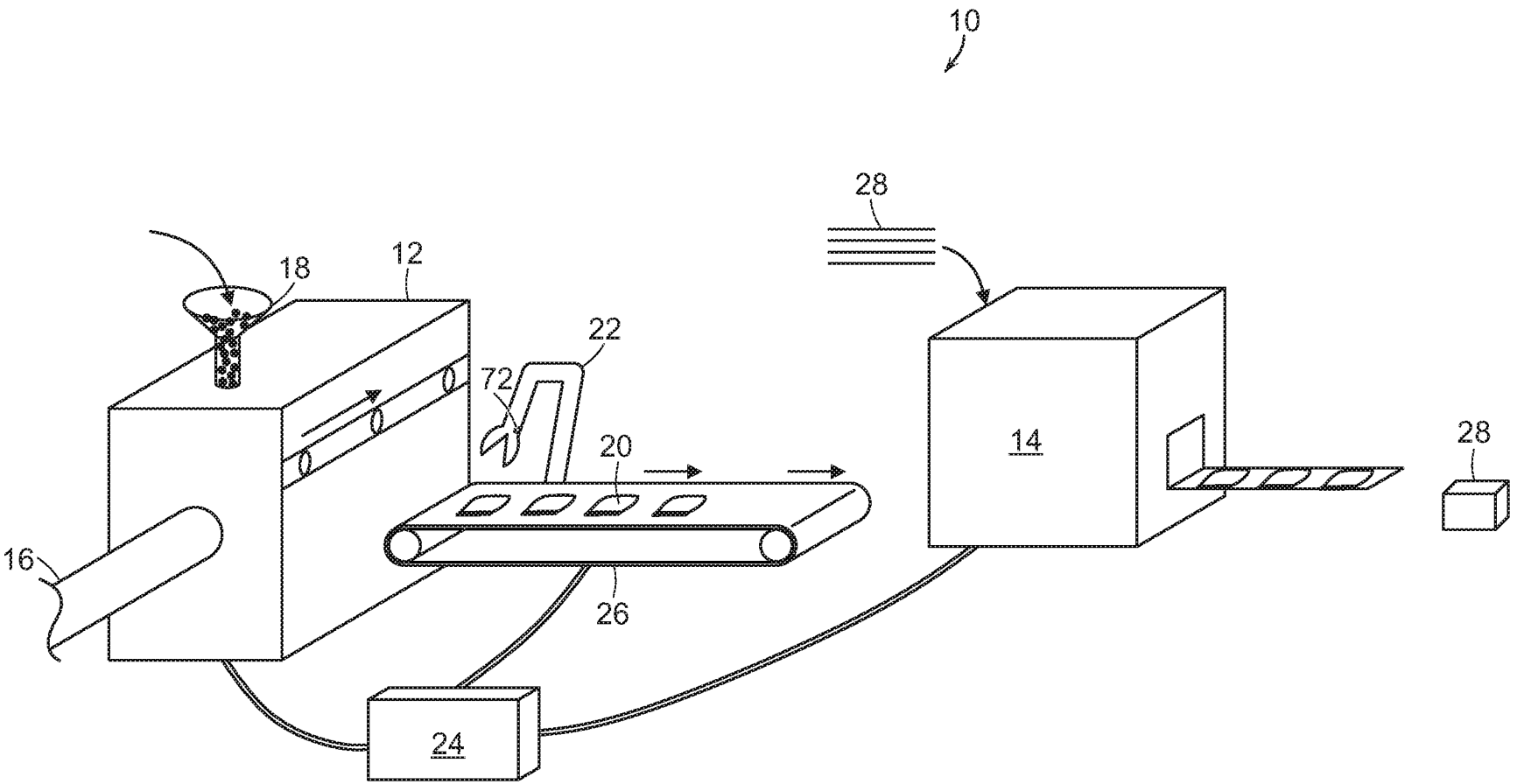
FIG. 1 shows a pouch packaging system.

A pouch packaging system 10, shown in FIG. 1, includes a pouch filler 12 and a pouch placer 14.

The pouch filler 12 receives a supply of webbing 16 and product 18. Its function is to form the webbing 16 into pouches 20, to place a measure of product 18 into each pouch 20, seal the pouch 20, which is now a filled pouch, and to present each such filled pouch 20 to a first robot arm 22 controlled by a control system 24. The first robot arm 22 places filled pouches 20 on a first conveyor belt 26, which then conveys the filled pouches 20 to the pouch placer 14.

The pouch placer 14 receives, as inputs, the filled pouches 20 from the pouch filler 12, and a supply of retail-ready cartons 28. The function of the pouch placer 14 is to erect these retail-ready cartons 28, receive pouches 20 from the pouch filler 12, and place these pouches 20 into the erected retail-ready cartons 28.

Figure 2:
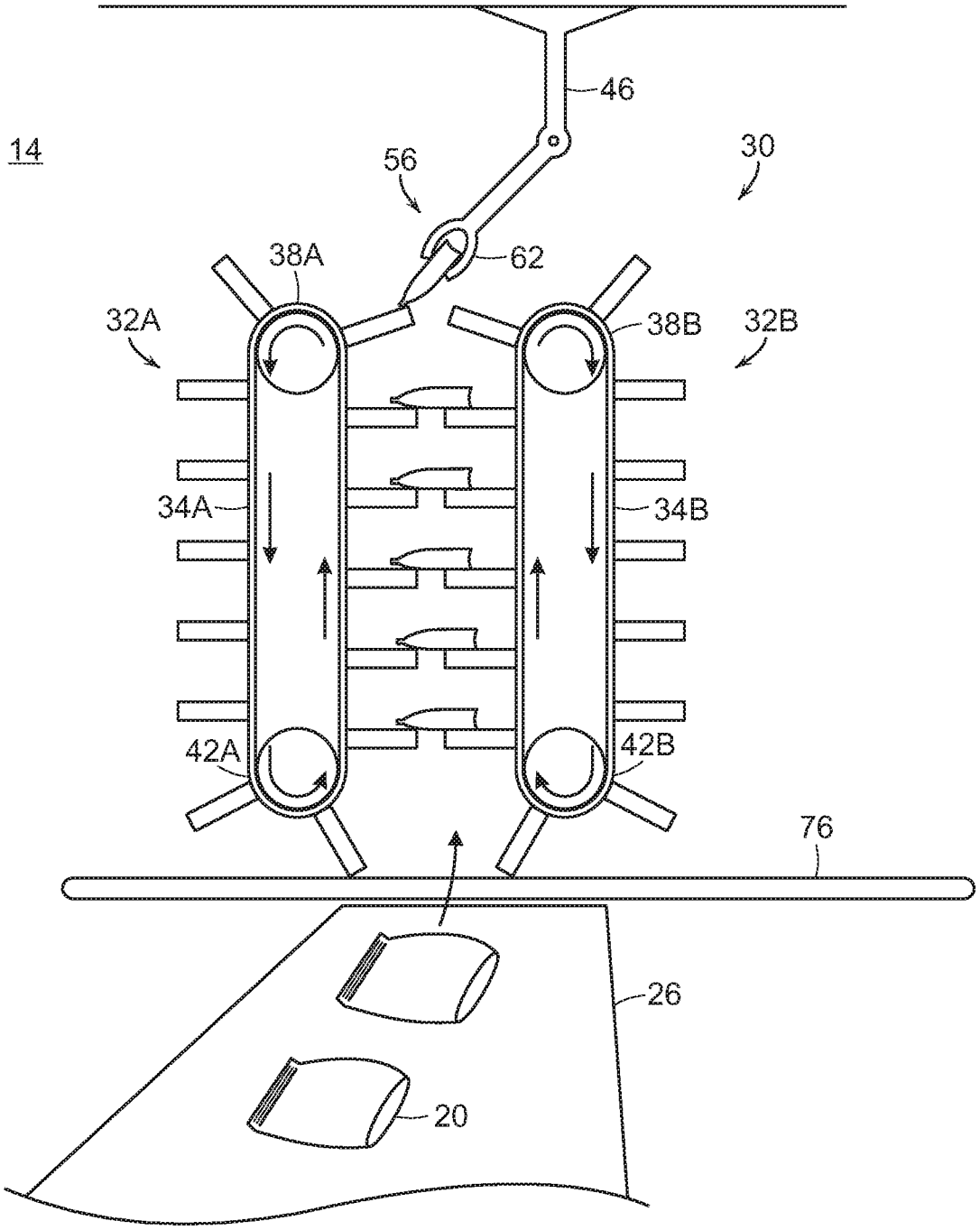
FIG. 2 is a view of the pouch placer from the pouch packaging system of FIG. 1 as seen from the point of view of an incoming pouch.

Referring now to FIG. 2, the pouch placer 14 features an elevator assembly 30. Embodiments of this elevator assembly 30 include those with one tower 32A and those with two towers 32A, 32B. In the particular embodiment shown in FIG. 2, the elevator assembly 30 features first and second twin elevator towers 32A, 32B.

Figure 3:
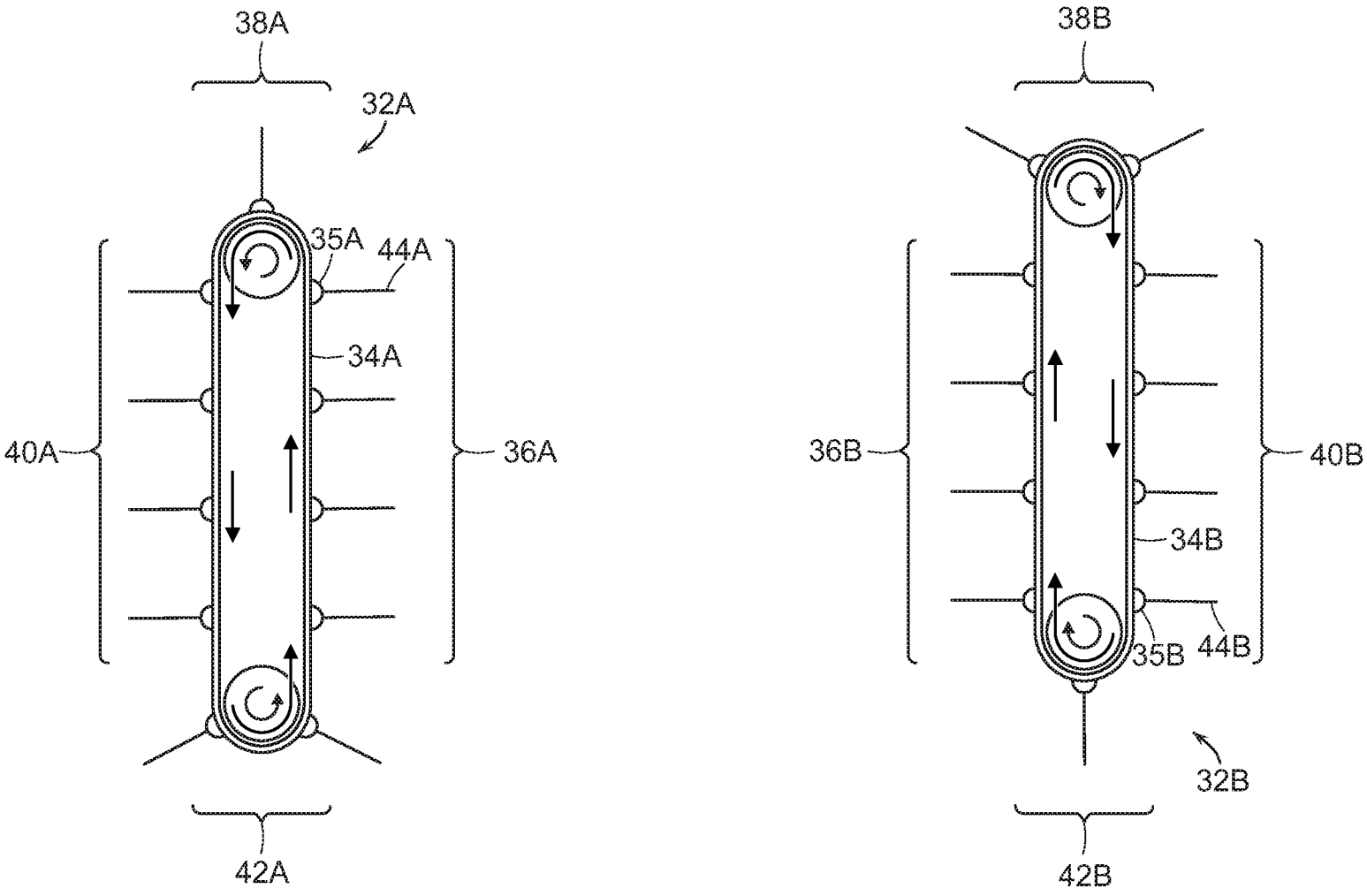
FIG. 3 shows a detailed view of the elevator towers from the pouch placer of FIG. 2.

Referring now to FIGS. 3A and 3B, the first tower 32A features a vertically oriented conveyor chain 34A that travels up an inner vertical section 36A of the first tower 32A, loops around an upper turnaround section 38A of the first tower 32A, travels down an outer vertical section 40A of the first tower 32A, and loops around a lower turnaround section 42A of the first tower 32A to begin its journey back up the inner vertical section 36A.

The second tower 32B is a mirror image of the first tower 32A in both structure and operation. Like the first tower 32A, the second tower 32B has a vertically oriented conveyor chain 34B that travels up an inner vertical section 36B of the second tower 32B, loops around an upper turnaround section 38B of the second tower 32B, travels down an outer vertical section 40B of the second tower 32B, and loops around a lower turnaround section 42B of the second tower 32B to begin its journey back up the inner vertical section 36B.

The second tower 32B is oriented such that the inner vertical section 36A of the first tower 32A faces an inner vertical section 36B of the second tower 32B.

Each conveyor chain 34A, 34B has, mounted thereon, regularly spaced clips 35A, 35B. Each clip 35A, 35B engages a paddle 44A, 44B that extends outwardly from the conveyor chain 34A, 34B in a direction perpendicular to the conveyor chain 34A, 34B. As the conveyor chain 34A, 34B moves, so too does each paddle 44A, 44B Movement of the paddles 44A of the first tower 32A and the paddles 44B second tower 32B is synchronized in both frequency and phase such that as a first paddle 44A from the first tower 32A traverses the inner vertical section 36A of the first tower 32A, a corresponding second paddle 44B also traverses the inner vertical section 36B of the second tower 32B at the same time. The first tower 32A and second tower 32B are separated such that a small gap exists between the first paddle 44A and the second paddle 44B.

The first paddle 44A and the second paddle 44B thus come together at a bottom end of their respective inner vertical sections 36A, 36B and cooperate to form a support surface for lifting a pouch 20 upwards, between the first and second towers 32A, 32B, for presentation to a second robot arm 46. Once the second robot arm 46 picks up the pouch 20, the first and second paddles 44A, 44B begin to move apart as each one traverses the upper turnaround section 38A, 38B of its corresponding tower 32A, 32B.

Referring back to FIG. 2, the first conveyor belt 26 is oriented to aim pouches 20 directly into the space between the first and second towers 32A, 32B. The movement of the paddles 44A, 44B is synchronized with that of the first conveyor belt 26 such that at the precise moment a pouch 20 reaches the space between the first and second towers 32A, 32B, the first and second paddles 44A, 44B are just beginning their upward journey along the inner vertical sections 36A, 36B of their respective towers 32A, 32B, where they are in the correct location for receiving the pouch 20.

Figure 4:
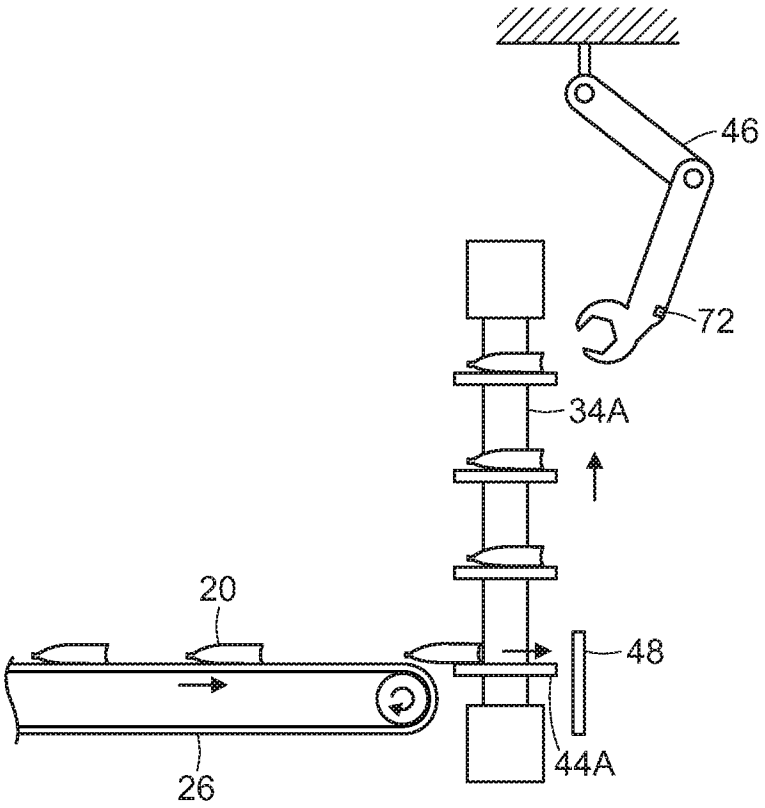
FIG. 4 shows the use of a backstop in one of the elevator towers of FIG. 2.

In general, it is difficult to impart exactly the correct velocity to a pouch 20 so as to have it come to rest at a desired position on the first and second paddles 44A, 44B. To avoid having to do so, a backstop 48 is placed behind the paddles 44A, 44B, as shown in FIG. 4. This backstop 48 prevents a pouch 20 from overshooting the first and second paddles 44A, 44B. The first conveyor belt 26 thus imparts sufficient velocity to the pouch 20 so that it can at least reach the backstop 48, and thus be positioned correctly. A suitable backstop 48 is implemented as one or more vertical rods or bars with the number being selected at least in part based on the size of the pouch 20.

Figure 5:
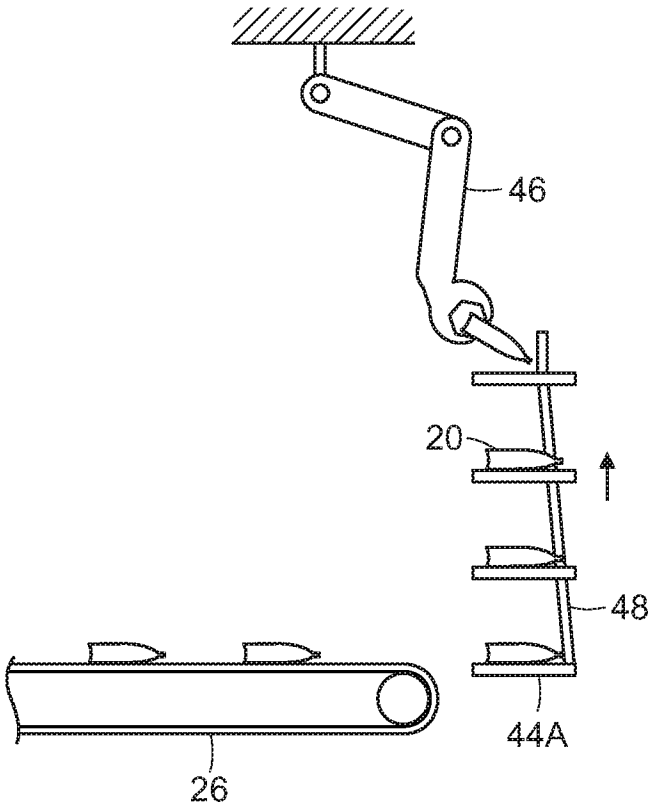
FIG. 5 shows a backstop like that in FIG. 4 but tilted to push a pouch towards a robot arm.

In some embodiments, the backstop 48 may not be vertical relative to the paddles 44A, 44B as the paddles 44A, 44B travel up the inner vertical sections 36A, 36B of their respective towers. Instead, the backstop 48 may be oriented to lean toward the first conveyor belt 26 and to extend upward at least part way along the inner vertical section 36A, 36B, as shown in FIG. 5. In these embodiments, the backstop 48 catches the pouch 20 when the first and second paddles 44A, 44B are at the bottom of the vertical inner section. Then, as the conveyor chains 34A, 34B lift the first and second paddles 44A, 44B up the inner vertical section 36A, 36B, the backstop 48 pushes the pouch 20 slightly forward, thus adjusting its position to prepare it for presentation to the second robot arm 46.

Figure 6:
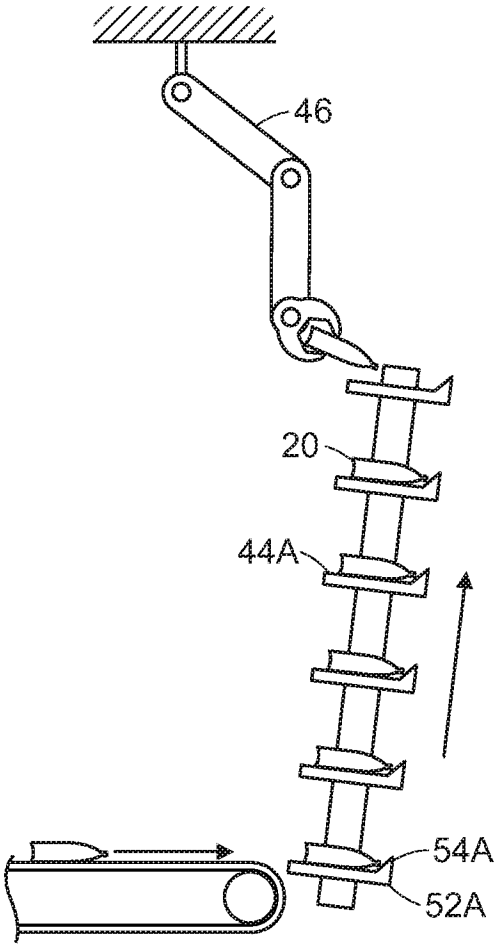
FIG. 6 shows a leaning version of the elevator tower of FIG. 3.
Figure 8:
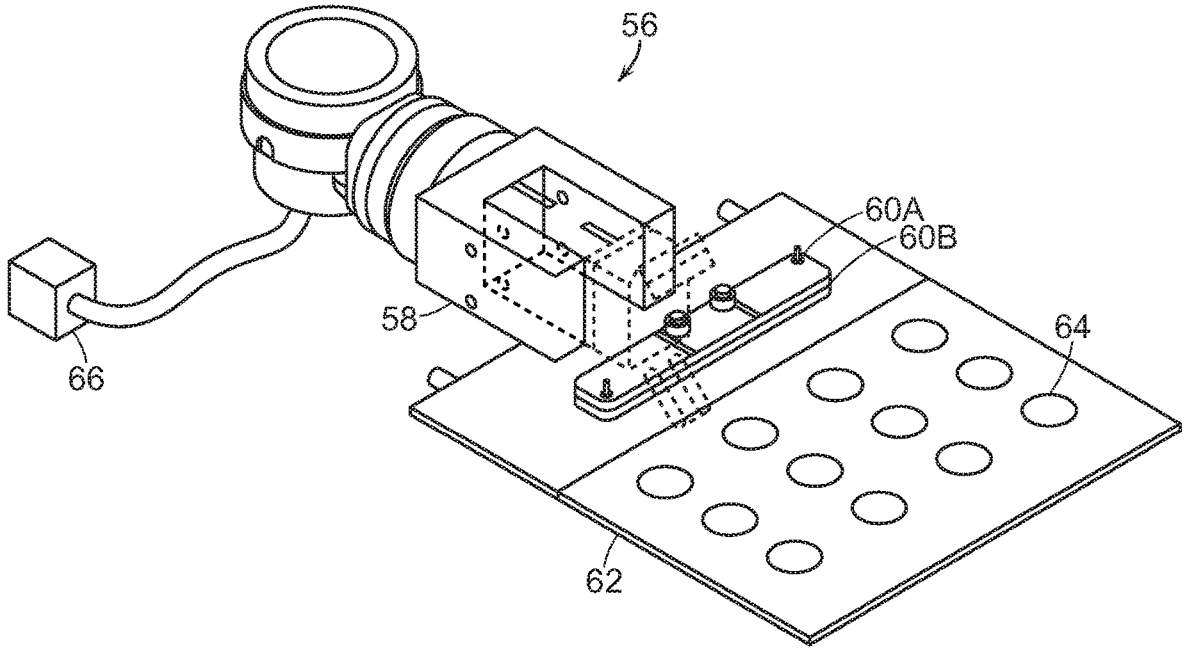
FIG. 8 shows an effector for a robot arm of the pouch placer of FIG. 2.

In another embodiment, shown in FIG. 6, the first and second towers 32A, 32B are tilted to lean away from the first conveyor belt 26. As a result, once a pouch 20 lands on the first and second paddles 44A, 44B, gravity urges the pouch 20 toward a side 52A, 52B of the paddle 44A, 44B furthest from the first conveyor belt 26. In this embodiment, it is preferable to have a lip 54A, 54B at the end of the paddle 44A, 44B that is furthest from the first conveyor belt 26 to prevent the pouch 20 from falling off the paddle 44A, 44B altogether.

Figure 7:
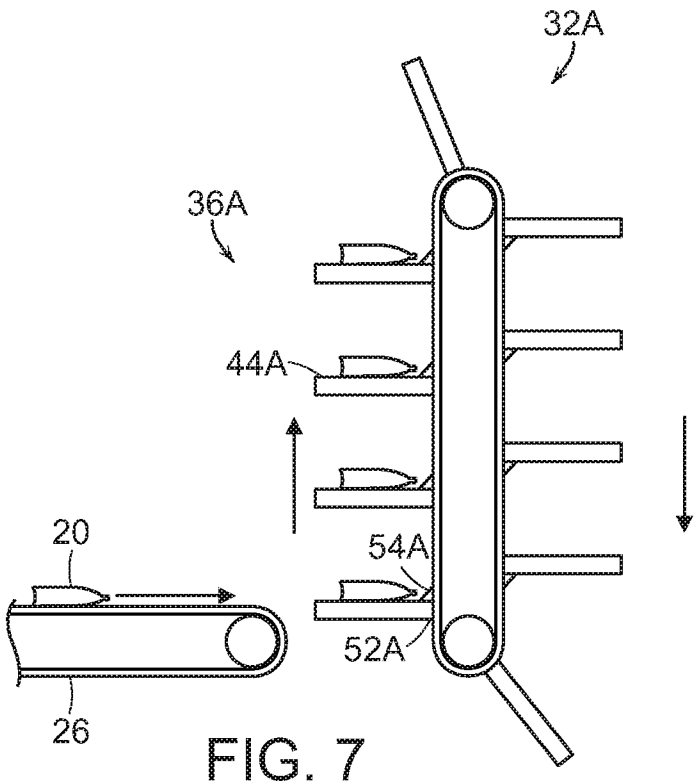
FIG. 7 shows an elevator tower from a pouch placer having a single-tower elevator system.

Another embodiment, shown in FIG. 7, has only a single tower 32A. In this embodiment, the inner vertical section 36A of the tower 32A faces the first conveyor belt 26. In this embodiment, it is again preferable for the side 52A of a paddle 44A away from the first conveyor belt 26 to have a lip 54A to function as a backstop.

As was the case in the preceding embodiment, which had twin towers 32A, 32B, the sole tower 32A in the single-tower embodiment can also be made to lean away from the first conveyor belt 26, thus enabling gravity to urge the pouch 20 to remain in the paddle 44A.

Referring to FIG. 6, a robot arm effector 56 includes a clamp 58 having first and second grippers 60A, 60B that cooperate to engage an edge of the pouch 20. For small pouches 20, this arrangement is sufficient. However, when a pouch 20 clamped at an edge thereof is picked up, the free portion of the pouch 20 tends to dangle like a pendulum. This makes it difficult for the second robot arm 46 to control the pouch 20 while moving it and attempting to place it in a retail-ready carton 28.

To avoid this difficulty, it may be useful for a lower one of the two grippers 60B to have a spatula 62 extending therefrom. When a clamp having such a spatula lifts the pouch 20 off a paddle, the spatula 62 supports the pouch 20 and assists in guiding the pouch 20 to its proper position in the retail-ready carton 28.

In another embodiment, the spatula 62 includes holes 64 connected to a vacuum source 66. In this embodiment, as the second robot arm 46 lifts the pouch 20 off the paddle 44A, the vacuum source 66 turns on and causes a vacuum that secures the pouch 20 to the spatula 62. Then, when the second robot arm 46 places the pouch 20 in its proper place in the retail-ready carton 28, the vacuum source 66 either turns off or reverses itself to gently blow the pouch 20 off of the spatula 62.

In some cases, a pouch 20 is incorrectly filled, for example by having too much or too little product 18 placed therein. These pouches 20 are preferably rejected. To address this, it is useful to provide one of the first and second robot arms 22, 46 with an accelerometer 72. Since the overall force applied to the robot arm 22, 46 is known, measurements of the arm's acceleration provide a basis for inferring the pouch's weight. Based on data from this accelerometer 72, the control system 24 determines whether the pouch 20 should be placed on the first conveyor belt 26 or on a third conveyor belt 74, which takes pouches 20 to a reject pile.

An advantage of the apparatus described herein is the ease with the elevator assembly 30 and the second robot arm 46 can be adapted to accommodate different pouches 20.

The first and second towers 32A, 32B are mounted to and horizontally movable along a horizontal guide 76. The towers 32A, 32B are spaced apart by a distance that corresponds to a linear dimension of the pouch 20. Since the pouch placer 14 is intended to work with different size pouches 20, the variable spacing between the towers 32A, 32B provides adjustment for different size pouches 20.

In addition, it is a simple matter to detach the paddles 44A, 44B from the clips 35A, 35B on the conveyor chain 34A, 34B and to attach different paddles having different dimensions, which can then accommodate different size pouches 20. Finally, the backstop 48 can be adjusted, for example by changing the number of vertical rods or bars 50A, 50B and their positions in a manner that is optimized for the dimensions of a particular pouch 20.

Customizability of the second robot arm 46 arises from its interchangeable effector 56. Effectors 56 can vary in the dimensions of the grippers 60A, 60B, in the texture of the gripping surface of the grippers 60A, 60B, in the presence or absence of a spatula 62, and in the presence or absence of a vacuum source 66, and in the size and configuration of the holes 64.

Having described the invention, and a preferred embodiment thereof, what we claim as new, and secured by Letters Patent, is:

1. An apparatus for placing pouches in retail-ready cartons, said apparatus comprising a pouch placer comprising an elevator assembly having paddles for receiving pouches provided by a first conveyor, and lifting said pouches, and a first robot arm for retrieving a pouch from a paddle of said elevator assembly and placing said pouch in a retail-ready carton, wherein said first robot arm is configured to retrieve at most one pouch from a paddle and to place no more than one pouch at a time into said retail-ready carton.

2. The apparatus of claim 1, further comprising a weight-measurement device for weighing a pouch while said pouch is being moved.

3. The apparatus of claim 2, wherein said weight measurement device is integrated with at least one of said first robot arm and a second robot arm.

4. The apparatus of claim 2, further comprising a second robot arm for causing pouches to be provided to said pouch placer, said weight measurement device being integrated with said second robot arm.

5. The apparatus of claim 1, wherein said first robot arm comprises an effector, wherein said effector comprises a clamp having a spatula, an upper gripper, and a lower gripper, wherein said upper and lower grippers have faces opposed to each other for gripping a pouch, wherein said spatula extends from said lower gripper, and wherein, when said clamp lifts a pouch off a paddle, said spatula supports said pouch.

6. The apparatus of claim 5, further comprising a vacuum source, wherein said spatula comprises a surface having holes in communication with said vacuum source.

7. The apparatus of claim 1, further comprising a pouch filling machine for providing filled pouches to said pouch placer.

8. The apparatus of claim 1, wherein said pouch placer is further configured for erecting retail-ready cartons for receiving said pouches and providing said erected cartons to said first robot arm.

9. The apparatus of claim 1, wherein said elevator assembly comprises a first elevator tower, and a chain for conveying paddles up a vertical section of said first elevator tower.

10. The apparatus of claim 9, further comprising a second elevator tower and a chain conveying paddles up a vertical section of said second elevator tower, wherein said vertical section of said second tower faces said vertical section of said first tower.

11. The apparatus of claim 10, further comprising a horizontal guide, wherein said first and second towers are mounted to be horizontally movable along said horizontal guide to accommodate pouches of different sizes.

12. The apparatus of claim 1, wherein said robot arm comprises an interchangeable effector.

13. The apparatus of claim 1, wherein said conveyor imparts said pouches with sufficient velocity to reach said paddles from said first conveyor.

14. The apparatus of claim 1, wherein said paddles are disposed beyond an end of said first conveyor.

15. The apparatus of claim 1, further comprising a backstop to prevent a pouch from overshooting said paddle.

16. The apparatus of claim 1, wherein each paddle comprises a lip at an edge thereof for preventing a pouch from falling off said paddle.

17. The apparatus of claim 1, wherein each paddle is oriented so as to urge a pouch supported thereon to fall off said paddle.

18. The apparatus of claim 1, wherein said elevator assembly comprises clips for engaging said paddles, thereby permitting said paddles to be interchangeable to accommodate pouches of different sizes.

* * * * *